United States Patent [19]

Kropik

[11] 4,261,585

[45] Apr. 14, 1981

[54] INNER SEALS FOR THE KNUCKLE PINS CONNECTING THE LEGS OF A DRILLING AND/OR PRODUCTION PLATFORM WITH KNUCKLE POSTS

[75] Inventor: Ernst Kropik, Nuernberg, Fed. Rep. of Germany

[73] Assignee: MAN Maschinenfabrik Augsburg-Nuernberg AG, Nuernberg, Fed. Rep. of Germany

[21] Appl. No.: 167,223

[22] Filed: Jul. 14, 1980

[30] Foreign Application Priority Data

Jul. 26, 1979 [DE] Fed. Rep. of Germany ..... 2930297

[51] Int. Cl.[3] ..... F16J 15/34

[52] U.S. Cl. ..... 277/206 A; 277/92; 277/190

[58] Field of Search ..... 277/92, 206, 190, 191; 305/11

[56] References Cited

U.S. PATENT DOCUMENTS

| | | | |
|---|---|---|---|
| 3,184,246 | 5/1965 | Kline | 277/206 |
| 3,455,562 | 7/1969 | Burtis | 277/206 |
| 3,948,574 | 4/1976 | Baylor | 277/92 |
| 4,193,604 | 3/1980 | Sarvanne | 277/190 |
| 4,204,716 | 5/1980 | Baylor | 277/206 R |

*Primary Examiner*—Robert I. Smith
*Attorney, Agent, or Firm*—Karl H. Gross

[57] ABSTRACT

This invention relates to seals for the knuckle pins connecting the legs of a drilling and/or production platform to the knuckle posts which are connected to spud tanks.

3 Claims, 5 Drawing Figures

Figure 1:
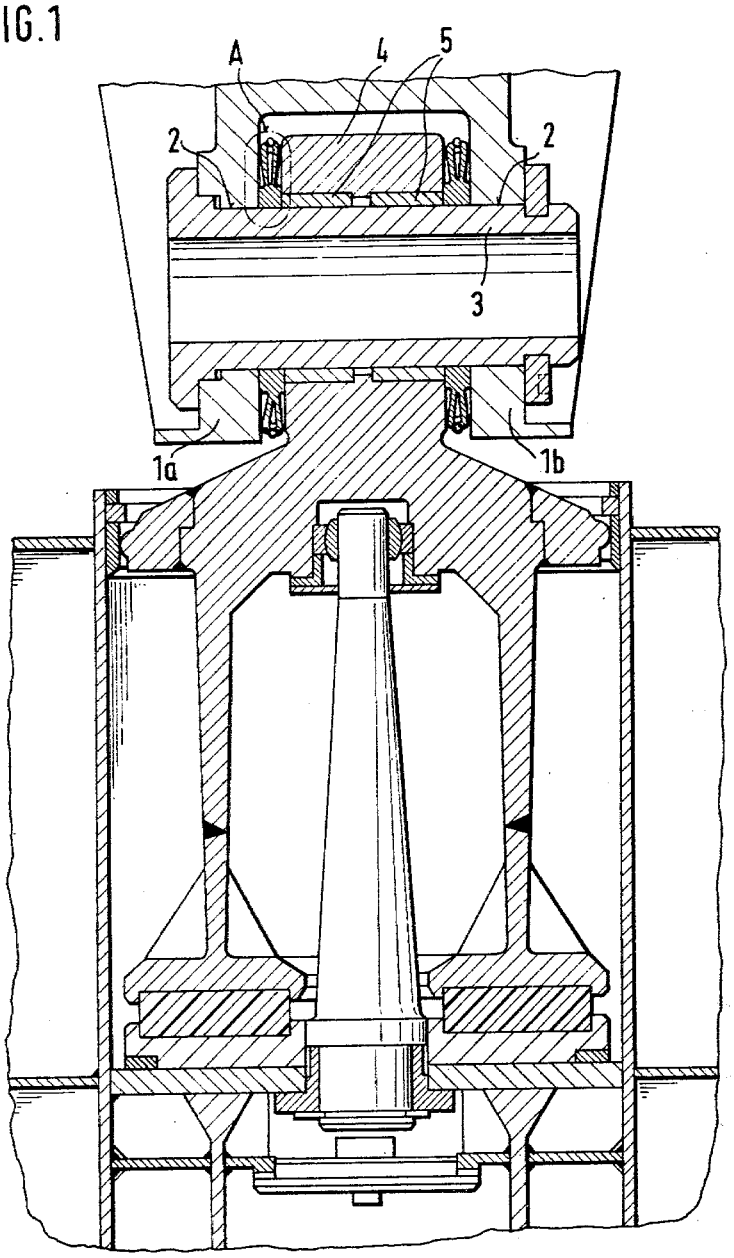

INNER SEALS FOR THE KNUCKLE PINS CONNECTING THE LEGS OF A DRILLING AND/OR PRODUCTION PLATFORM WITH KNUCKLE POSTS

The legs of a drilling and/or production platform are proposed to be articulately jointed to their allied spud tanks using knuckle pins joining the legs to corresponding knuckle posts which are connected to the spud tanks. This type of joint has spacer rings or spacer discs arranged between the inner side surfaces of the legs and—depending on the specific design of the articulated joint—the end surfaces of the knuckle post (bearing eyes) and, respectively, the inner ring of a spherical knuckle bearing. In view of assembling fits such as are inevitable in the case of large steel structures such as drilling and/or production platforms, sea water is liable to penetrate through axial gaps between the spacer rings and corresponding radial gaps and cause rust in the knuckle bearings. Since, in addition, the action of waves, drilling operations or similar factors are liable to give rise to small movements of the knuckle pins relative to the knuckle posts, the original fits existing between the knuckle pins and the bearing bushes and inner rings respectively tend to deteriorate in the course of time.

The object is therefore to provide an inner seal which prevents the ingress of seawater. This seal is required to be effective both during the transfer or the platform to and erection of the platform at the destination and during the actual operation of the platform; this requirement continues to exist during operation of the platform when wear occurs in the seals in the course of time due to the abovementioned motions of the knuckle pins relative to the knuckle post.

This object is achieved—depending on the design of the knuckle post in the region of the knuckle pins—by the features described in the characterizing part of claims 1 and 2.

A further development of the support arrangement according to the invention consists in the fact that the sealing rings are mounted on rings supported on the spigots, that an elastic intermediate ring is arranged between the sealing rings and their allied sealing plate, and that the outer side surfaces of the ring are adapted to be pressed against the inner side surfaces of the leg parts or the inner side surfaces of the leg parts and the side surfaces of the knuckle eye respectively.

Figure 2:
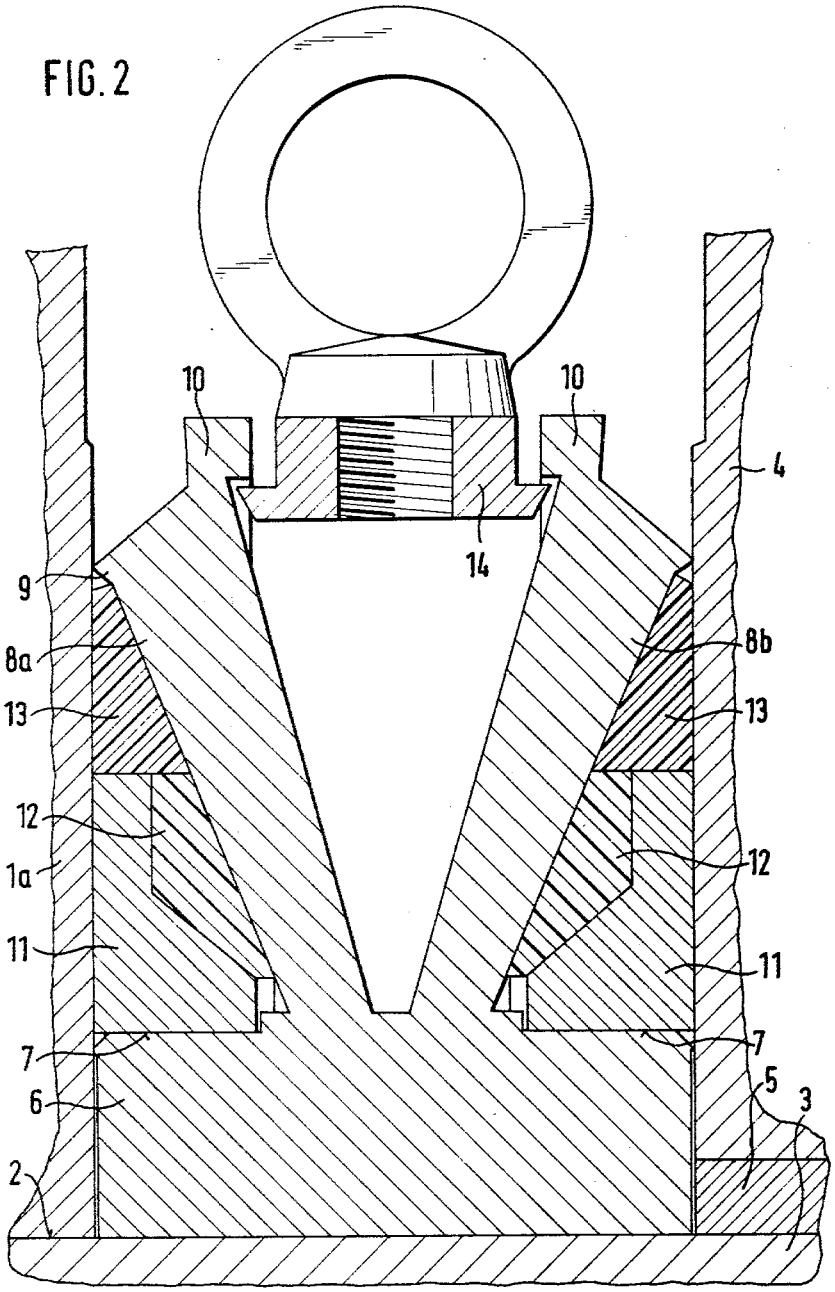
Figure 3:
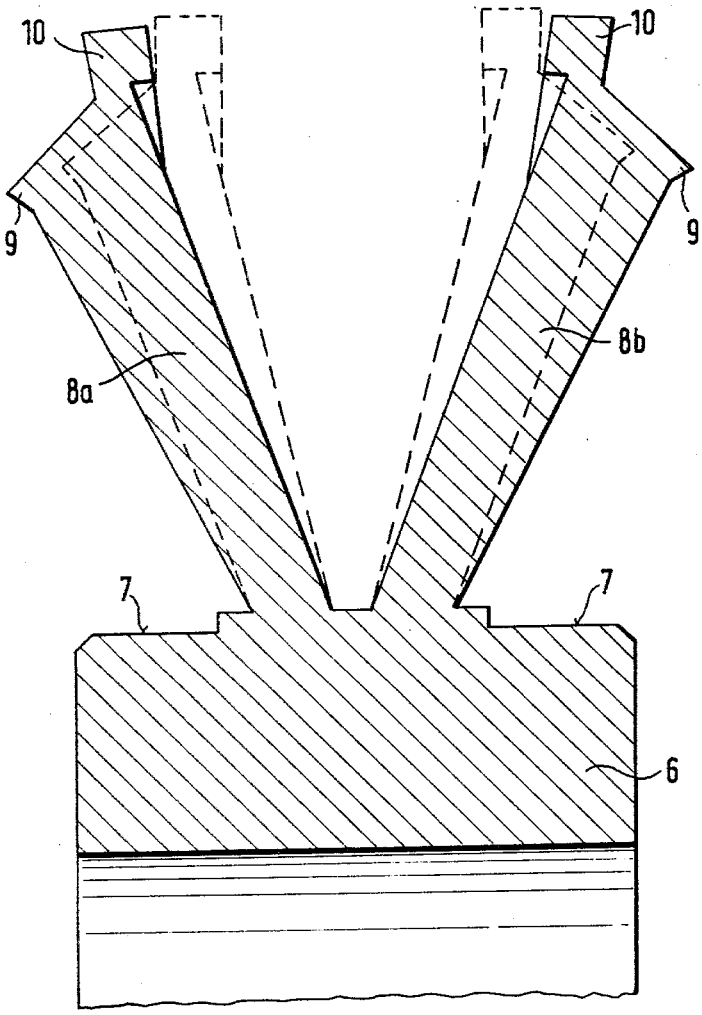
Figure 4:
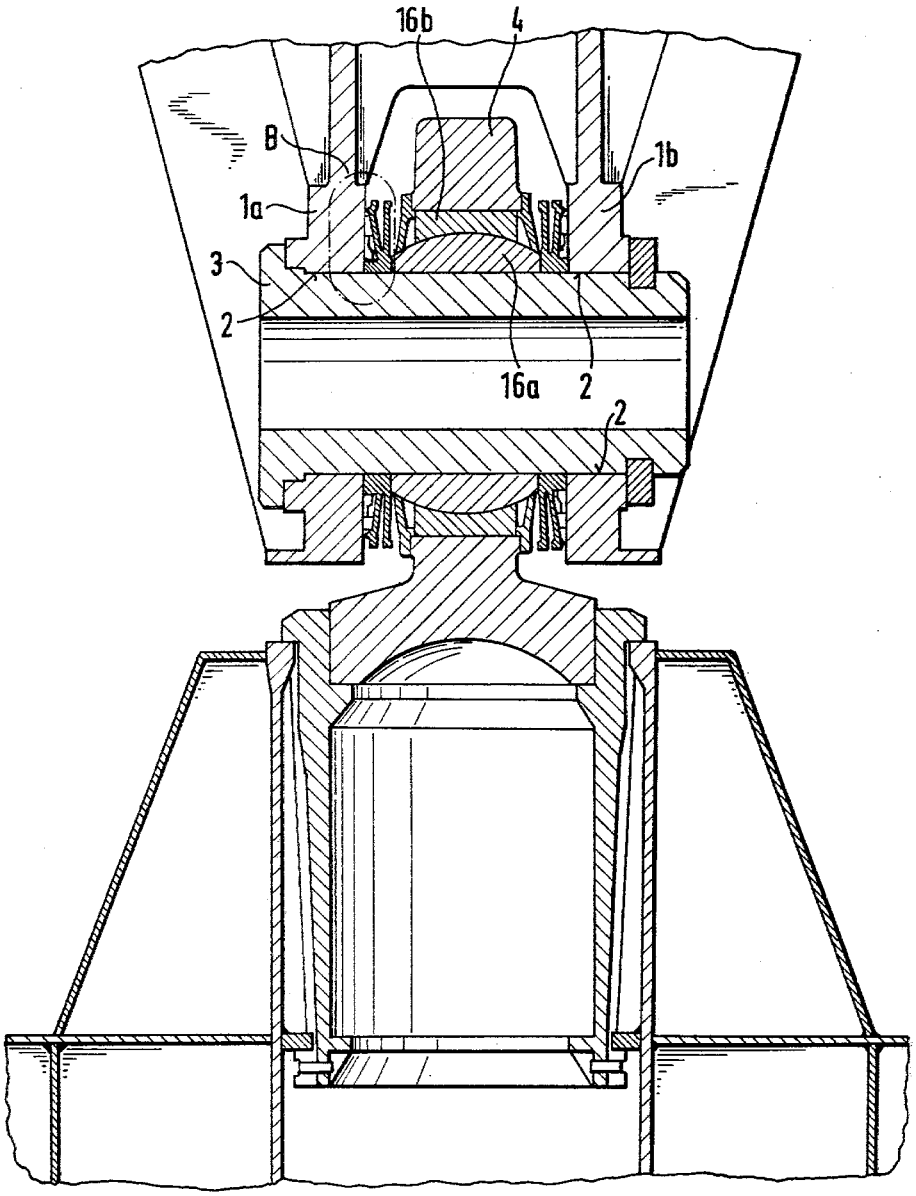
Figure 5:
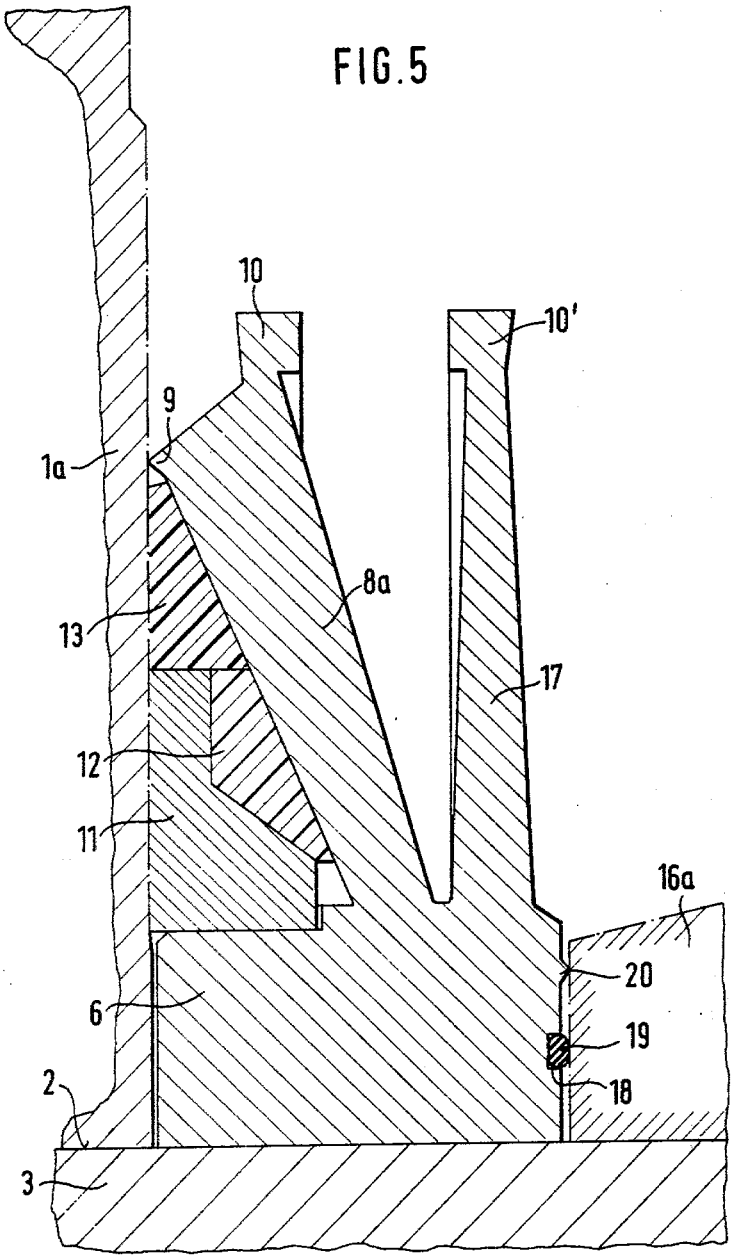

Typical embodiments of the invention are shown schematically in the drawing in which:

FIG. 1 is a section through the joint between the leg and the knuckle post,

FIG. 2 a part section according to detail A in FIG. 1 showing the inner seal, but on a larger scale compared to FIG. 1, FIG. 3 a detail—knuckle pin with sealing plates—of FIG. 1 in the assembly condition and operating condition, FIG. 4 a section through another joint between the leg and the knuckle post and FIG. 5 a part section according to detail B in FIG. 4 of the inner seal, but on a larger scale compared to FIG. 4.

An offshore platform for use as a drilling and production platform is proposed to be formed with three slanting steel legs which are each articulated with a spud tank. This offshore platform is intended in particular for operation in water depths of from 200 m to 500 m.

Each leg is formed at its lower end with a forked part 1*a*, 1*b* having coaxial holes 2 for lateral entry and support of a hollow knuckle pin 3. Each knuckle pin 3 is supported in a manner preventing it to turn relative to the leg parts 1*a*, 1*b* and secured against displacement in an axial direction.

In the case of the embodiment illustrated in FIGS. 1 and 2, the bearing eye 4 of a knuckle post is connected in the region between the leg parts 1*a*, 1*b* with the knuckle pin 3 with bearing bushes 5 interposed. The bearing bushes 5 are arranged in a manner preventing them to turn relative to the bearing eye 4; however, the knuckle pin 3 and the bearing bushes and knuckle posts respectively are pivoted relative to each other about the longitudinal centreline of the knuckle pin 3 (The knuckle post arrangement is described in detail and illustrated in an earlier application No. P 2921 886.8 of the applicant).

Suitable space is provided between the leg parts 1*a*, 1*b* and the bearing eye 4 of the knuckle post to accommodate double-action seals—the seals according to the invention are provided on all three legs of the drilling and/or production platform.

Since both of the two seals provided for each leg are identical, only one of the seals is described in the following.

Each seal is formed with a hub 6 supported on the knuckle pin 3 and having spigots 7 at its ends as well as two sealing plates 8*a*, 8*b* which are integral with the centre parts of the hub 6 and made of suitable seawater-resistant spring steel, spring bronze or a similar metal or metal alloy. The outer end surfaces of the sealing plates 8*a*, 8*b* are formed with a ring-shaped edge-type sealing ridge 9 in the radially outward range—alternatively, sealing ridges with a blunter edge or wider contact surface may be provided—the sealing edges 9 may be an integral part of the sealing plate 8*a*, 8*b*, but they may also take the form of separate rings with (ring-shaped) sealing edges or a sealing surface to be connected to the sealing plate. For reasons of easier transport and assembly, the sealing plates 8*a*, 8*b* are formed with suitable lugs 10 extending radially outwards.

Mounted on each of the two spigots 7 of the hub 6 is a rigid (non-elastic) ring 11 made of suitable seawater-resistant steel, copper, bronze or a similar metal or metal alloy. The rings 11 are each formed with a plane outer end surface and each with a cylindrical outer diameter and inner diameter as well as a suitably formed inner end surface. Between the inner end surface of each ring 11 and the outer end surface of the associated sealing plate 8*a*, 8*b*, there is an elastic intermediate ring 12 which is preferably made of a seawater-resistant elastomer—the intermediate rings 12 are firmly bonded to the rings 11 and the sealing plates 8*a*, 8*b* which may be effected, for instance, by vulcanizing or glueing. The rings 11 are a slide-fit on the spigots 7 and are capable of being moved axially according to the assembling fit to enable them to be pressed against the inner surfaces of the leg parts and the side surfaces of the bearing eye relative to the hub. An elastic sealing ring 13 is supported on the cylindrical outer diameter of each of the rings 11. The sealing rings 13 are formed with plane outer end surfaces and tapering inner end surfaces matching the tapering outer surfaces of the sealing plates 8*a*, 8*b*. The sealing rings 13 extend to a point a short distance ahead of the sealing ridges 9. The material used for the sealing rings 13 is preferably a seawater-resistant elastomer; however, other elastic seawater-resistant materials can be used, too. The sealing rings 13 are preferably firmly bonded to the sealing plates 8*a*, 8*b* for instance by vulcanizing or glueing.

The material used for the sealing elements should be of a type which ensures a long service life (abt. 25 years) of the seals.

For the purpose of handling and installation of the seals, a supporting element 14 with an eye, hoop or similar member engaging the lugs 10 from below is inserted between the inner surfaces of the sealing plates 8*a*, 8*b*. Installation of the supporting element 14 is with the sealing plates 8*a*, 8*b* spread apart. Installation of the seal is in the dry dock or similar facility. The installation procedure is for the sealing plates fitted with the support element 14 to be forced inwards when a number of clamps engaging the lugs 10 from the top are applied distributed over the full circumference to locate the sealing plates 8*a*, 8*b* in the installation position (the clamps remain applied only during the installation procedure; they are removed after the seals are in place). During the handling and installation phase of the seal, the support element 14 bears against the underside of the lugs 10 (after handling and installation, the support element 14 together with the eye or similar fitting can be removed). The assembled seals are lowered into place from the top until the hole of the hub 6 is in alignment with the holes in the leg parts and the holes of the bearing bushes; finally, the knuckle pin 3 is inserted from the side and located axially.

In the typical embodiments illustrated in FIGS. 4 and 5, the inner seals differ in part which is necessary due to the configuration of the knuckle post with a spherical knuckle bearing 16 (concave inner ring 16*a*; convex outer ring 16*b*) between the bearing eye 4 and the knuckle pin 3). The spherical knuckle bearing of the articulated joint is described and illustrated in an earlier application No. P 2856 475.2 of the applicant).

The arrangement of the seals according to FIGS. 4 and 5 differs from the above described seals in that the inner sealing plates 8*b* and the associated elastic and rigid rings as well as the inner spigot are omitted. Instead of the inner sealing plate 8*b*, each hub 6 is formed with a holding disc 17 extending radially outwards with lugs 10' corresponding to the lugs 10. The holding discs 17 are required only to facilitate handling and installation. Sealing of the axial gaps between the inner end surface of each hub 6 and the mating end surfaces of the inner ring 16*a* of the spherical knuckle bearing is by conventional type seals. For instance, each seal may consist of one (or a plurality of) concentrically arranged O-ring 19 (or O-rings) made of a seawater-resistant elastomer fitted in a ring groove 18 (or a ring groove each) in the hub 6. A ring-shaped, edge-type sealing ridge 20 contacting the mating end surface of the inner ring 16*a* may be provided in the radially outward range of each hub 6.

The articulated joint is additionally protected from sea water or similar factors by covers enclosing the bearing eye 4; the outer seal, i.e. the seal preventing the ingress of sea water from outside the legs into radial gaps existing due to the assembling fit between the holes 2 and the knuckle pin 3 is not the object of the present invention. The outer seal may, for instance, be provided in a manner known per se by the provision of gaskets and clamping the knuckle pin 3 axially relative to the leg parts 1*a*, 1*b*.

The sealing elements (9, 11, 12, 13) are inherently forced continuously against the inner faces of the leg parts and the faces of the bearing eye by the strong spring force of the sealing plate or sealing plates 8*a*, 8*b*. This spring action provides an adequate sealing effect against the ingress of sea water while transferring the offshore platform afloat to its destination at sea and during final erection of the offshore platform at the site of operation. As the legs of the offshore platform are lowered down onto the sea bed and during operation of the offshore platform, the forces resulting from the pressure of the sea water additionally act upon the sealing pates, whereby the sealing action is considerably increased because the seals will be at a very great depth. Therefore, any wear occurring on the sealing surfaces or in individual sealing elements in the course of time will not reduce the sealing effect because the water pressure will cause both an automatic adjustment of the sealing elements at the sealing points and ensure that a sufficiently high contact pressure continues to be available.

I claim:

1. Seals for the legs of a drilling and/or production platform having knuckle joints connecting the legs to the spud tanks, characterized in that two hubs (6) each with two resilient circular sealing plates (8*a*, 8*b*) made of a seawater-resistant spring steel, spring bronze or similar metal or metal alloy and capable of being acted upon by the seawater pressure are arranged on each knuckle pin (3) between the solid inner faces of the leg parts (1*a*; 1*b*) and the side faces of the bearing eye (4), and in that the sealing plates (8*a*, 8*b*) are each formed on their outer end faces in the radially outward range with a ring-shaped edge-type sealing ridge (9) or a ring-shaped sealing surface as well as being provided with at least one sealing ring (13) made of a seawater-resistant elastic material, typically a suitable elastomer and capable of being pressed against the inner faces of the leg parts and/or the side faces of the bearing eye in the area inside the sealing ridge or sealing surface mounted on the hub (6).

2. Seals for the legs of a drilling and/or production platform with a knuckle joint connecting the legs to the spud tanks, characterized in that two hubs (6) each with a resilient sealing plate (8*a*) made of a seawater-resistant spring steel, spring bronze or similar metal or metal alloy and capable of being acted upon by the seawater pressure are mounted on each knuckle pin (3) between the solid inner faces of the leg parts and the side faces of the inner ring (16*a*) of a knuckle bearing, and that the sealing plates (8*a*) are each formed with a ring-shaped edge-type sealing edge (9) or a ring-shaped sealing surface on their outer end surfaces in the radially outward region and, in the region inside the sealing ridge or sealing surface are provided with at least one sealing ring (13) made of a seawater-resistant elastic material, typically a suitable elastomer and capable of being pressed against the inner face of the associated leg part (1*a*; 1*b*) mounted on the hub (6), and in that the axial gaps between the hubs (6) and the end faces of the inner ring (16*a*) are sealed by means of suitable seals (e.g. 18, 19, 20).

3. Seals as in claims 1 or 2, where the knuckle pins are formed with cylindrical spigots, characterized in that the sealing rings (13) are supported on rings (11) bearing on the spigots (7) and in that an elastic intermediate ring (12) each is provided between the sealing rings (13) and the associated sealing plate (8*a*, 8*b*; 8*a*), and in that the outer end faces of the rings (11) are capable of being pressed against the inner faces of the leg parts and, respectively, the inner faces of the leg parts and the side faces of the bearing eye.

* * * * *